US009050493B2

(12) United States Patent
Perez

(10) Patent No.: US 9,050,493 B2
(45) Date of Patent: Jun. 9, 2015

(54) RESISTANCE BAND EXERCISE STATION

(75) Inventor: Oscar Perez, Los Angeles, CA (US)

(73) Assignee: Core Energy Fitness Systems, LLC, Los Angeles, CA (US)

( * ) Notice: Subject to any disclaimer, the term of this patent is extended or adjusted under 35 U.S.C. 154(b) by 225 days.

(21) Appl. No.: 13/069,002

(22) Filed: Mar. 22, 2011

(65) Prior Publication Data

US 2011/0237410 A1 Sep. 29, 2011

Related U.S. Application Data

(60) Provisional application No. 61/316,723, filed on Mar. 23, 2010.

(51) Int. Cl.

*A63B 21/04* (2006.01)
*A63B 21/055* (2006.01)
*A63B 21/16* (2006.01)

(52) U.S. Cl.

CPC ..... *A63B 21/0557* (2013.01); *A63B 21/16* (2013.01); *A63B 2225/09* (2013.01); *A63B 21/0442* (2013.01); *A63B 21/0552* (2013.01); *A63B 2021/169* (2013.01)

(58) Field of Classification Search

CPC .. A63B 21/0442; A63B 21/004; A63B 21/02; A63B 21/0552; A63B 2021/00; A63B 2021/169; A63B 21/0557

USPC ..... 482/129, 40; 248/220.31, 220.41, 248/220.22, 217.4, 304; 211/57.1, 59.1, 211/87.01; 223/85; 24/452; D6/323

See application file for complete search history.

(56) References Cited

U.S. PATENT DOCUMENTS

| | | | | | |
|---|---|---|---|---|---|
| 113,209 | A | * | 3/1871 | Scott | 248/224.51 |
| 224,003 | A | * | 2/1880 | Drew | 248/304 |
| D11,889 | S | * | 7/1880 | Spencer | D6/323 |
| 251,613 | A | * | 12/1881 | Maschmeyer | 248/304 |
| 267,656 | A | * | 11/1882 | Woodward | 248/217.4 |
| 280,611 | A | * | 7/1883 | Hammond | 248/217.4 |
| 317,343 | A | * | 5/1885 | Grimes | 211/106.01 |
| D17,911 | S | * | 11/1887 | Howell | D6/316 |
| 533,193 | A | * | 1/1895 | Granger | 114/218 |

(Continued)

OTHER PUBLICATIONS 10,000 lb Capacity Tow Hook Kit, http://www.discountramps.com/recovery-hook.htm, last visited Jan. 7, 2014.*

(Continued)

*Primary Examiner* — Loan H Thanh
*Assistant Examiner* — Rae Fischer
(74) *Attorney, Agent, or Firm* — Withrow & Terranova, P.L.L.C.

(57) ABSTRACT

The resistance band exercise station disclosed here is a modular hooking system used to perform a myriad of exercises with various exercise tools that require anchoring such as standard resistance bands, suspension straps and stretch straps. The resistance band exercise station includes multiple components: one or more lower units each having column(s) of vertically spaced safety hooks for exercises performed at various heights, from the ankle to eye level, and an upper unit having one or more safety hooks used for exercises performed above the head. The multiple lower and upper units are wall mounted in varying heights. The safety hooks are used to anchor resistance bands, suspension straps and stretch straps from one or multiple points. The safety hooks are open-loop hooks having a barrier member such as a T-bar at the tip to prevent the straps from slipping out.

20 Claims, 19 Drawing Sheets

(56) References Cited

U.S. PATENT DOCUMENTS

| | | | | | |
|---|---|---|---|---|---|
| 570,384 | A | * | 10/1896 | Demorest | 211/50 |
| D32,957 | S | * | 7/1900 | Lewis | D8/382 |
| 846,956 | A | * | 3/1907 | Shaw | 211/32 |
| 1,215,476 | A | * | 2/1917 | Brouillet | 248/220.31 |
| 1,369,706 | A | * | 2/1921 | Payne | 211/113 |
| 1,380,747 | A | * | 6/1921 | Stanford et al. | 211/1 |
| D128,002 | S | * | 7/1941 | Olney | D8/367 |
| D156,600 | S | * | 12/1949 | Brown | D8/372 |
| 2,842,264 | A | * | 7/1958 | Larson | 206/526 |
| 2,952,366 | A | * | 9/1960 | Botten | 211/104 |
| 3,189,376 | A | | 6/1965 | Johansson | |
| 3,618,942 | A | | 11/1971 | Bates | |
| 3,880,390 | A | * | 4/1975 | Niven | 248/220.43 |
| 4,304,382 | A | * | 12/1981 | Jelen | 248/220.42 |
| 4,657,149 | A | * | 4/1987 | Masson | 211/194 |
| 4,861,020 | A | * | 8/1989 | Soligny, Sr. | 482/40 |
| 4,932,538 | A | * | 6/1990 | Gambello | 211/87.01 |
| 5,072,934 | A | | 12/1991 | Blanes | |
| 5,626,546 | A | | 5/1997 | Little | |
| 5,766,118 | A | | 6/1998 | Conner | |
| 5,853,092 | A | * | 12/1998 | Goodman et al. | 211/70.6 |
| D416,785 | S | * | 11/1999 | Ming-Hsiao | D8/363 |
| 6,129,220 | A | * | 10/2000 | Decossas | 211/85.7 |
| 6,267,711 | B1 | | 7/2001 | Hinds | |
| 6,319,179 | B1 | | 11/2001 | Hinds | |
| 6,322,483 | B1 | | 11/2001 | Rotella | |
| D465,096 | S | * | 11/2002 | Ouyoung | D6/323 |
| D473,453 | S | * | 4/2003 | Goodman et al. | D8/367 |
| 6,681,940 | B1 | * | 1/2004 | Cash et al. | 211/70.6 |
| D489,250 | S | * | 5/2004 | Graves et al. | D8/367 |
| 6,908,418 | B2 | | 6/2005 | Saure | |
| 7,100,779 | B2 | * | 9/2006 | Berg | 211/87.01 |
| D544,221 | S | * | 6/2007 | Krumpe et al. | D6/323 |
| 7,322,554 | B2 | * | 1/2008 | Caroselli et al. | 248/304 |
| D573,828 | S | * | 7/2008 | Clokey et al. | D6/553 |
| D575,142 | S | * | 8/2008 | Goodman et al. | D8/370 |
| 7,625,325 | B1 | | 12/2009 | Yost | |
| D607,650 | S | * | 1/2010 | Krumpe | D6/323 |
| 2006/0040813 | A1 | | 2/2006 | Murphy et al. | |
| 2006/0084556 | A1 | | 4/2006 | Payne | |

OTHER PUBLICATIONS

Vestil—Swivel Hooks with Shackle, Http://vestilmfg.com/products/mhequip/swivel_hooks.htm, last visited Jan. 7, 2014.*

Mustad Saltwater Hooks and fishing tackle from alltackle.com, http://www.alltackle.com/mustad_saltwater_hooks.htm, last visited Jan. 7, 2014.*

ANSI/ASSE Z359 Fall Protection Code, Revisions Strengthen Benchmark Consensus Standard, A Technical Publication of ASSE's Engineering Practice Specialty, 2007.*

"PURMOTION functional training station fitness sports performance", Pur Motion, LLC, http://www.purmotion.net/trainerfinder/websites/60187/products/fts.html, 1 page, printed from the Internet on Mar. 22, 2011.

"PURMOTION patent pending Vector Trax for use with resistance bands", Pur Motion, LLC, http://www.purmotion.net/trainerfinder/websites/60187/products/vectortraining.html, 2 pages, printed from the Internet on Mar. 22, 2011.

International Search Report and Written Opinion in counterpart PCT application No. PCT/US2011/029454, dated May 19, 2011.

First Office Action for Chinese Patent Application No. 201180023502.0, mailed Jun. 4, 2014, 12 pages.

Author Unknown, "Dog Parking Facility," MDC Exports Ltd 2014, http://www.mdcexports.co.uk/?p=dogpark, accessed on Apr. 7, 2014, 2 pages.

European Search Report for European Patent Application No. 11760082.5, mailed Nov. 20, 2013, 6 pages.

* cited by examiner

RESISTANCE BAND EXERCISE STATION

This application claims priority under 35 USC §119(e) from U.S. Provisional Patent Application No. 61/316,723, filed Mar. 23, 2010, which is herein incorporated by reference in its entirety.

BACKGROUND OF THE INVENTION

1. Field of the Invention

The invention relates to exercise equipment and, in particular, it relates to wall mounted exercise devices that enable users to utilize standard resistance bands, suspension training straps and stretch straps in a number of exercise protocols and therapeutic applications.

2. Description of the Related Art

Resistance Bands

Due to its low cost, portability, ease-of-use and versatility, resistance bands have become the leading exercise tool among personal trainers and physical therapists. With its simple, low cost design elements and broad fitness and therapeutic applications, resistance bands have achieved wide acceptance among fitness and therapeutic professionals and become a standard piece of exercise equipment that is found in virtually every aspect of the fitness and therapeutic industries.

A number of companies manufacture and market resistance bands (e.g., Spri™, Power Systems™, Perform Better™, Thera-Band™). The three most commonly used forms of resistance bands are standard resistance bands; "JC" bands; and flat bands. Standard resistance bands consist of rubber tubing measuring about 5 feet in length with handles on each end. JC Bands are made with two five-foot rubber tubes with handles on one end and a connector at the other end that secure the bands side by side. The other side of the connector is a loop strap used to secure the JC Band to an anchoring device. Flat bands are four-inch wide flat resistance bands that come in rolls of 50 yards. These are most commonly used in therapy environments where varying lengths of the bands are used for therapeutic exercise. All versions of these bands come in varying strengths including, most commonly, extra light, light, medium, heavy and extra heavy. With so many manufacturers in the market and its ubiquitous use, resistance bands have become a de facto commodity in the fitness industry.

While there are a number of resistance band exercise devices in the market, for a myriad of reasons, none of them facilitate the versatility of the three most commonly used forms of resistance bands as an exercise tool. Many resistance band programs for home use fasten resistance bands to standard doors through the use of nylon door straps and clamps. Exercise Apparatus by Payne, U.S. Pat. Appl. Pub. No. 2006/0084556 A1 published Apr. 20, 2006 uses an anchoring strap to "... secure the exercise apparatus to either a door frame or to another immovable object" (Abstract). In Apparatus for Exercising Abdominal Muscles by Conner, U.S. Pat. No. 5,766,118 issued Jun. 16, 1998 the device is attached to the door with a clamp that is fastened to the top of a door or wall.

The Adjustable Strap and Band Exercise Device Mountable on Door by Rotella, U.S. Pat. No. 6,322,483 issued Nov. 27, 2001, is a resistance band adjustable strap that loops vertically around a door and is secured by a locking mechanism. On one side of the strap are a series of loops running from the floor to the top of the door. Users slip resistance bands through the strap loops to execute their exercises. A very similar device is Door Mounted Deadman for Exercise Device by Saure, U.S. Pat. No. 6,908,418 issued Jun. 21, 2005. This device also uses a door mounted strap and tension-locking clamp to secure the band vertically around the door. The only difference between Rotella and Saure, is Saure uses D-rings in place of nylon strap loops to anchor resistance bands.

There are a number of professional grade wall mounted exercise devices on the market that use resistance bands in various forms to execute exercises. Many of these exercise devices such as the Thera-Band Wall Station, require the use of proprietary resistance bands, i.e., bands made by Thera-Band that can only be used with the Thera-Band Wall Station. None of the three most commonly used resistance bands noted can be used with this device.

The Thera-Band Wall Station is a vertical single rail system with an adjustable arm that allows for continuous height adjustment. Proprietary resistance bands (i.e., "Thera-Band clip connect tubing") are fastened to the device via clip hooks. A similar system is the Lifeline Wall Gym and the Lifeline Wall Gym Workstation. The Lifeline Wall Gym is a double rail pulley system and the Lifeline Wall Gym Workstation is a single rail system. Both require the use of proprietary resistance bands (i.e., "Lifeline Plugged Fitness Cables").

The devices noted above are very similar in context to Wall Mounted Exercise Unit by Little, U.S. Pat. No. 5,626,546. This device is a double rail system that employs a vertically sliding "wall mount channel" that is locked in place within the rail by a "clevis pin." Other similar devices include Elastic Cord Exercise Assembly by Hinds, U.S. Pat. No. 6,267,711; and Single Spine Elastic Cord Exercise Assembly by Hinds, U.S. Pat. No. 6,319,179.

There are also a number of wall mounted exercise devices on the market that use standard resistance bands, i.e., five-foot rubber tubing with handles on each end. The Web Slide Rail Wall Gym, manufactured by Cano, is a single rail system that uses nylon straps to anchor resistance bands to the wall unit. With numerous anchor points along a single vertical axis, the Web Slide Rail Wall Gym allows the user to adjust the height and angle of the resistance band. Due to the nylon loop anchor, standard JC Bands (i.e., with its closed loop design for anchoring the band) cannot be used with the device.

Suspension Training

Over the past several years, exercises using suspension straps have grown in popularity. A form of bodyweight training, suspension straps are made of nylon straps that are attached or anchored to a fixed object of sufficient strength to support a person's weight. Suspension exercise is a derivative of "rings" in gymnastics.

The straps typically consist of three components: anchoring portion of the strap; the portion of the strap that is used for exercises; and handles on each end of the training portion of the strap. In a gym setting, suspension straps are anchored to a number of devices including a large floor standing a-frame structure, a wall mounted frame and a wall mounted closed loop B-ring.

The user fastens the suspension strap to the anchoring device by: wrapping the strap around the anchoring device and locking it into place with a carabineer; or with a clip hook or carabineer directly to a closed loop anchor.

To adjust the length of straps, most of the commercially available straps use adjustment buckles and strap extenders. The buckles operate like a common luggage strap buckle that increases or decrease the length of the strap. Strap extenders are straps of varying lengths that increase the length of the anchoring portion of the strap. These straps are attached together using carabineers or clip hooks.

There are several companies marketing and selling suspension straps. The most popular is TRX™ Suspension Trainer™ from Anytime Fitness. Other suspension products include Jungle Gym XT and The Human Trainer™.

Stretch Straps

Stretching using stretch straps is another popular therapeutic modality. To perform a stretch, the body must be put in a position to lever and lengthen the muscle being stretched.

Stretch straps are commonly used in both fitness and therapeutic applications to create the necessary angles to lever the body. In their most simple form of a stretch strap is a yoga strap. This is a six to ten feet of yoga strap with a buckle on one end. The buckle is used to form a closed loop at one end of the strap for anchoring the strap to a foot or wrist. Once the foot or wrist is anchored, the user pulls the other end of the strap to execute the stretch. There are a number of other stretch straps on the market including the Stretch Out™ Strap. A more complex version of a yoga strap, the Stretch Out™ Strap is a six-foot strap with 10 loops used for grabbing or foot placement.

SUMMARY OF THE INVENTION

Embodiments of the present invention provide the platform for a wide variety of exercise devices that must be anchored to a secure base. These devices include, but are not limited to, resistance bands, suspension straps and stretch straps. For convenience, they may be collectively referred to as exercise bands. Also, although the exercise stations are referred to as resistance band exercise stations for convenience in this disclosure, it should be understood that they can accommodate a variety of exercise devices as indicated above.

There are a number of key deficiencies with the prior devices noted above and other commercial exercise devices used for resistance band exercises, suspension straps and stretch straps:

(A) Most of the devices noted above do not accommodate all of the most commonly used types of resistance bands. Most require the use of proprietary resistance bands. This limitation does not allow fitness and rehab facilities to use standard resistance bands, the number one piece of exercise equipment used by personal trainers and physical therapy professionals.

(B) All of the devices use "closed loop" devices (e.g., nylon loops, d-rings, anchoring pins, tethering hooks, clip hooks, pulley assemblies) to connect the bands or straps to their anchoring structures. While effective, closed loop anchoring devices can be cumbersome and limit utilization of the most commonly used forms of resistance bands, i.e., standard resistance bands, JC Bands and flat bands. Furthermore, closed loop anchoring devices do not facilitate transitions between resistance band exercises. To use a closed loop anchor, the user must thread the band through the closed loop. When moving on to the next exercise, the user must remove the band from the closed loop. These few seconds are a lifetime on the training floor. It is inconvenient and wastes time. In many cases, users permanently affix a number of bands of different levels of resistance to one closed loop because it is too cumbersome to fasten and unfasten bands through these types of anchors.

Because suspension straps are typically fixed to one anchor, they are commonly used with closed loop anchors.

(C) All of the devices noted herein can only accommodate one user at a time. Efficient utilization of equipment and space are critical variable in both fitness and rehabilitative environments. Preferably, a piece of exercise equipment should accommodate multiple users.

(D) All of the devices noted herein, the user must be positioned directly in front of the unit to use the device. In those devices that use nylon loop anchors, using the devices from an angle (not directly in front of the device) may cause the nylon loop anchor to disengage resulting in a potentially dangerous accident. In the other devices, pulling from a side angle could cause structural failure of the devices (not structurally designed to be pulled from the side) resulting in another potentially dangerous accident. It should be noted that in a fitness and rehabilitative environment, users frequently use fitness equipment inappropriately.

Accordingly, the present invention is directed to a resistance band exercise station that substantially obviates one or more of the problems due to limitations and disadvantages of the related art.

An object of the present invention is to provide a resistance band exercise station that is flexible, can accommodate various types of resistance bands and other exercise devices that require anchoring to a fixed object (e.g., suspension straps, stretch straps, ropes), and is easy and safe to use.

Additional features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, the present invention provides an exercise station which includes: one or more lower units, each lower unit having a first hook mounting structure and a first plurality of open-loop hooks each for accommodating an exercise band, the first plurality of hooks being mounted on the first hook mounting structure forming one or more vertical columns of hooks; and an upper unit having a second hook mounting structure and a second plurality of open-loop hooks each for accommodating an exercise band, the second plurality of hooks being mounted on the second hook mounting structure forming a horizontal row of hooks.

In this exercise station, each lower unit may further include one or more mounting plates attached to the first hook mounting structure for mounting the lower unit to a support structure, and the upper unit may further include one or more mounting plates attached to the second hook mounting structure for mounting the upper unit to the support structure.

The lower and upper units may include additional mounting plates for mounting the units to a support structure. The hook mounting structure of the lower and upper units may include an arc shaped hook mounting surface and one or more of gussets. The mounting plates, the hook mounting surfaces, the gussets and the safety hooks may be made of steel.

Each safety hook in the lower and upper units includes an elongated and curved hook body and a barrier member (such as a T-bar) disposed at a distal end of the hook body.

In another aspect, the present invention provides an exercise station having one or more hook units, each hook unit including: a hook mounting structure; and one or more open-loop hooks attached to the hook mounting structure, wherein each hook includes an elongated and curved hook body and a barrier member disposed at a distal end of the hook body.

It is to be understood that both the foregoing general description and the following detailed description are exemplary and explanatory and are intended to provide further explanation of the invention as claimed.

DETAILED DESCRIPTION OF THE PREFERRED EMBODIMENTS

Figure 1:
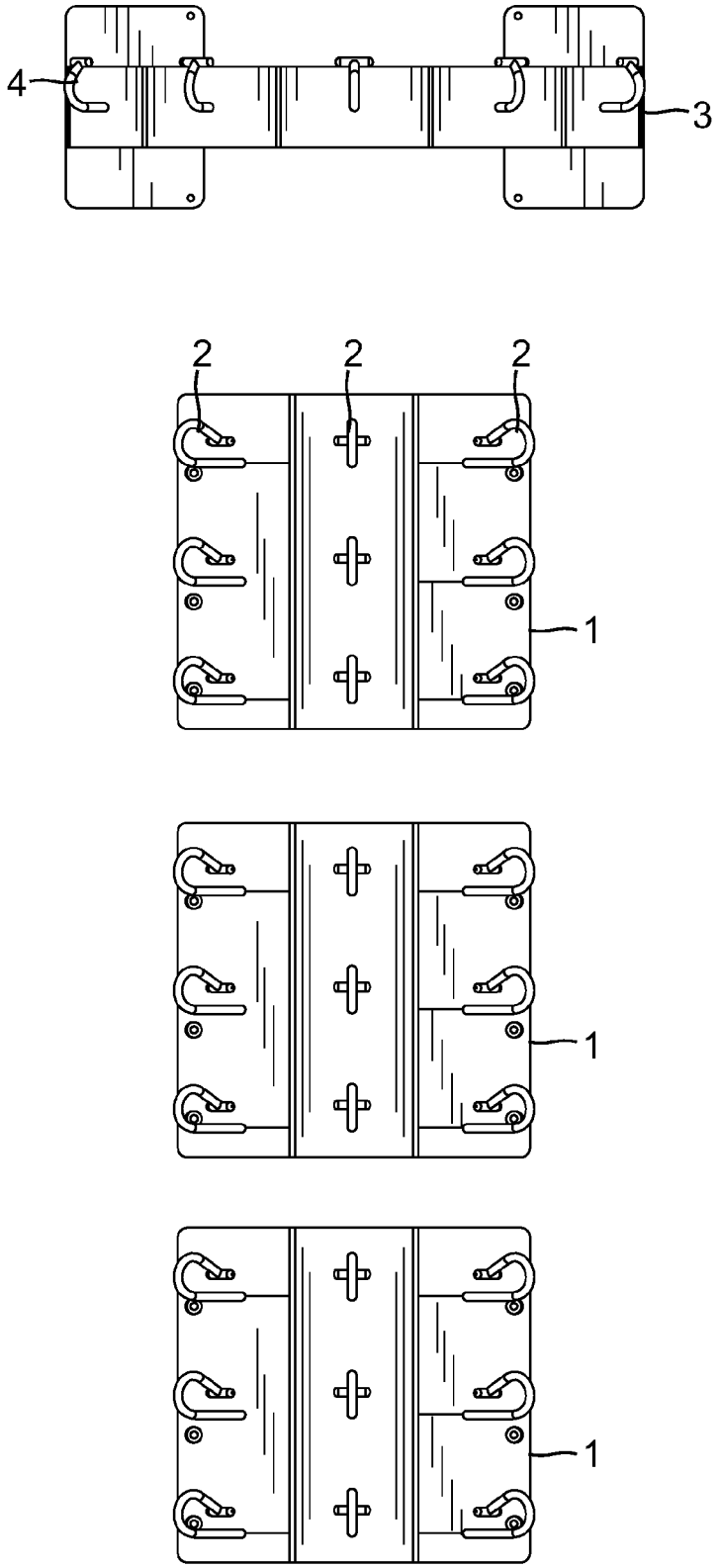
FIGS. 1-2 are front and side views of a multi-station resistance band exercise station according to a first embodiment of the present invention.
Figure 2:
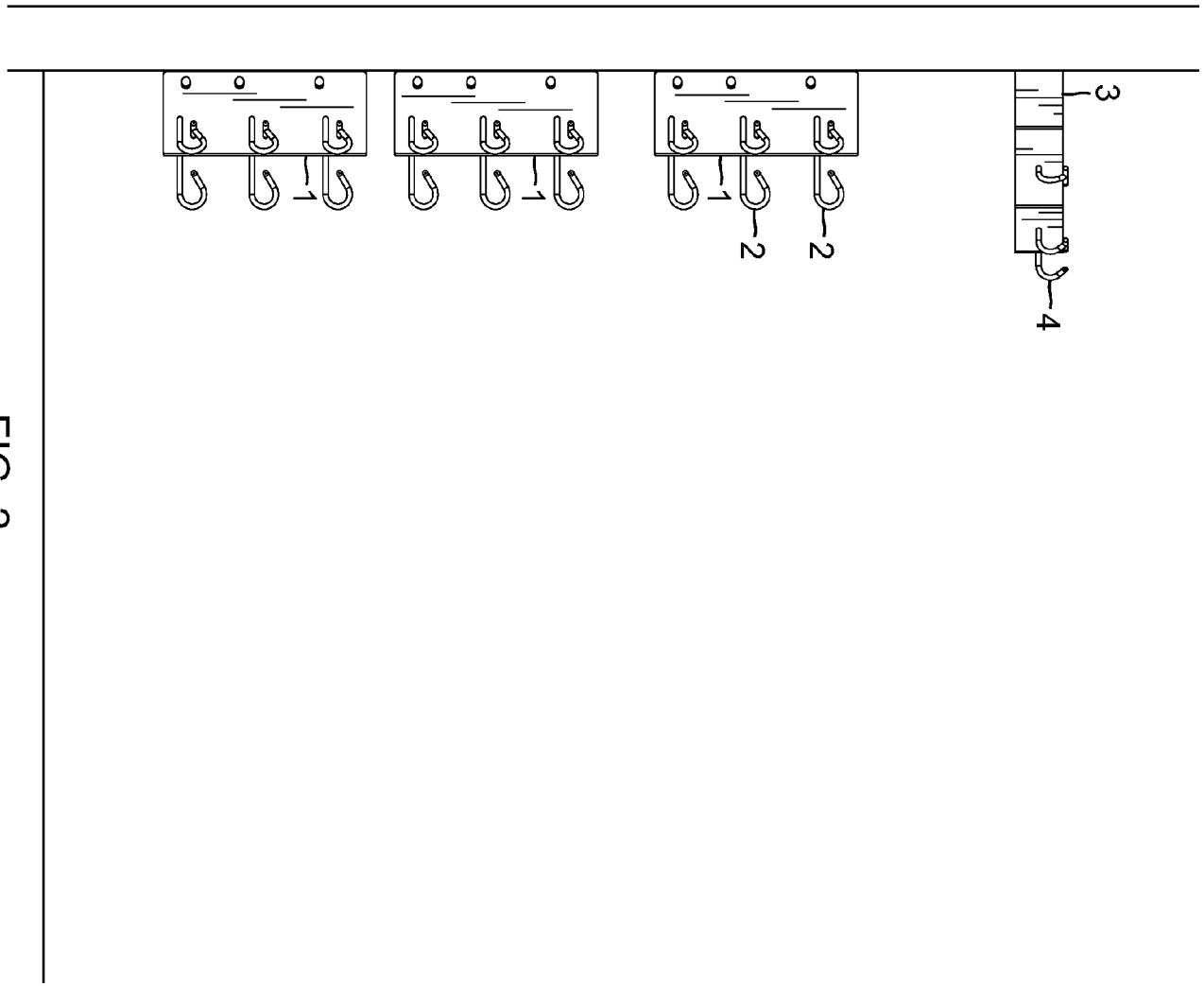
Figure 3:
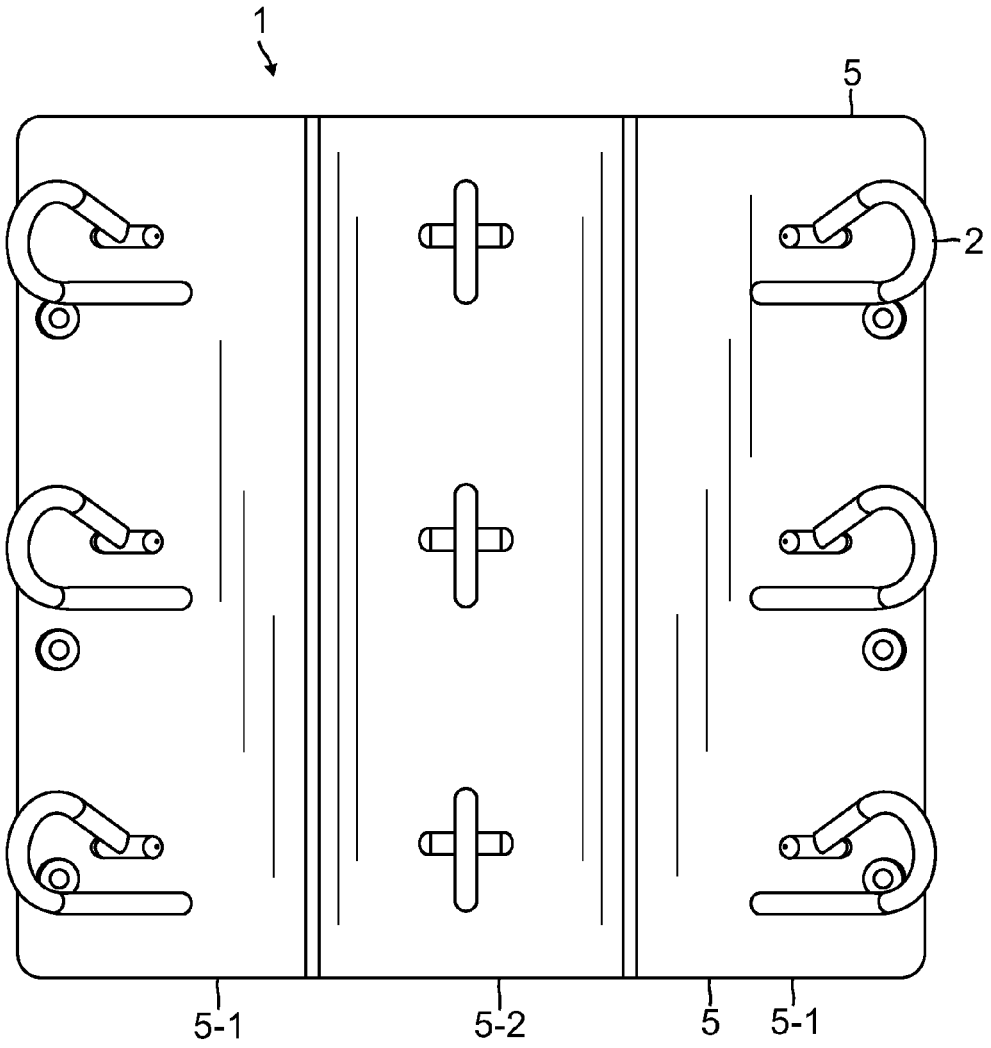
FIGS. 3-6 are front, side, top and back views of a lower unit of the multi-station resistance band exercise station of FIGS. 1 and 2.
Figure 4:
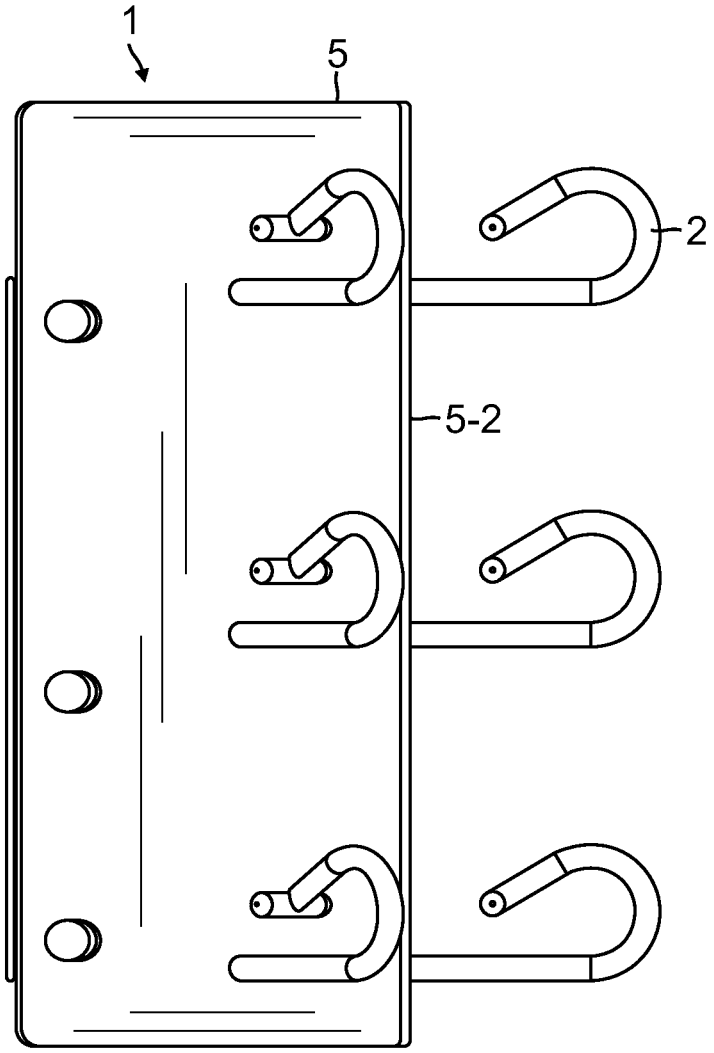

FIGS. 1-2 illustrate the general configuration of a resistance band exercise station according to a first embodiment of the present invention (also referred to as the multi-station embodiment).

The resistance band exercise station of the first embodiment includes two components: one or more (three are shown in FIGS. 1-2) lower units 1 each including a vertically shaped mounting surface providing a strong and stable platform for column(s) of vertically spaced safety hooks 2 for exercises performed at various heights, from the ankle to eye level; and one or more (one is shown in FIGS. 1-2) upper units 3 each having a horizontally shaped mounting surface with a horizontal row of safety hooks 4 used for exercises performed above the head. Preferably, the resistance band exercise station has multiple lower and upper units 1 and 3 wall mounted in varying heights to provide anchoring points at key angles from ankle height to above the head. The safety hooks 2 and 4 are used to anchor resistance bands from one or multiple points.

In the first embodiment of the invention, shown in FIGS. 1-2, the preferred configuration consists of three lower units 1 and one upper unit 3 that are wall mounted in varying heights to provide anchoring points at key angles from ankle height to above the head. FIGS. 18-21 illustrate some of the exercises that can be done using the resistance band exercise station, such as tricep press, upright row, bicep curl, and trunk rotations in lunge position, respectively.

In the preferred configuration, the four components 1 and 3 are wall mounted in a vertical stack with three lower units 1 and one upper unit 3. The bottom units 1 are positioned in a vertical column to provide the user with anchoring points from all angles, from ankle height to above the head. The upper unit 3 is mounted directly above the stack between, preferably, approximately 7.0 feet and 7.5 feet depending on the user's needs.

The components 1 and 3 can also be mounted in individual locations (i.e. not in a vertical column) creating up to four separate workstations, one exercise area for each component of the device. Further, the units 1 and 3 can also be mounted on a rack (e.g. two vertical rails made of steel) instead of wall-mounted. It should be noted that in this disclosure, the term "wall" should be generally understood to refer to any support structure suitable for mounting the units, whether it is a wall of a room or a rail of a free-standing rack or other support structures.

FIGS. 3-6 further illustrate the lower unit 1 in the first embodiment shown in FIGS. 1-2 (the multi-station embodiment). The lower unit 1 has a three-sided hook mounting surface 5 measuring, preferably, approximately 17.0 inches tall and approximately 17.5 inches wide. The mounting surface 5 is preferably made of steel. Designed in the shape of a three-sided arc, the unit 1 extends, preferably, approximately 11.5 inches from the wall to the forward edge of the hooks 2 mounted on the center panel 5-2 of the mounting surface 5 (i.e., the hooks furthest from the wall); and, preferably, approximately 7.0 inches from the wall to the forward edge of the mounting surface of the center panel 5-2 (see FIG. 4). Viewed from the front (see FIG. 3), the two side panels 5-1 of the mounting surface 5 are, preferably, approximately 9.0 inches wide and the front panel 5-2 of the mounting surface 5 is, preferably, approximately 6.0 inches wide. Preferably, three evenly spaced safety hooks 2 are attached (preferably by welding) to each of the side and front panels 5-1 and 5-2 and optionally to a supporting structure behind the mounting surface 5 (e.g., gussets, described later) in a vertical line for a total of nine safety hooks 2 (see FIG. 3). Depending on perspective, the nine hooks 2 form either three vertical columns of hooks or three horizontal rows of hooks.

Figure 5:
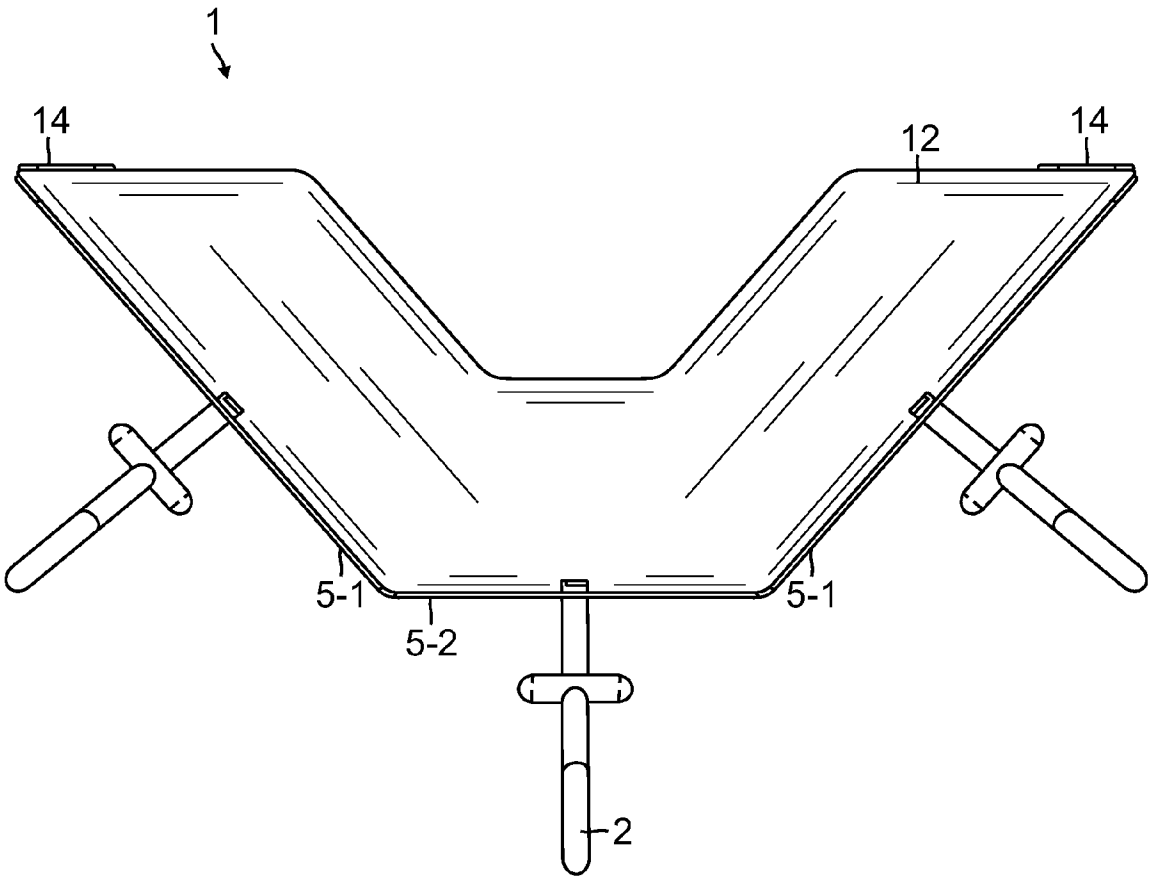
Figure 6:
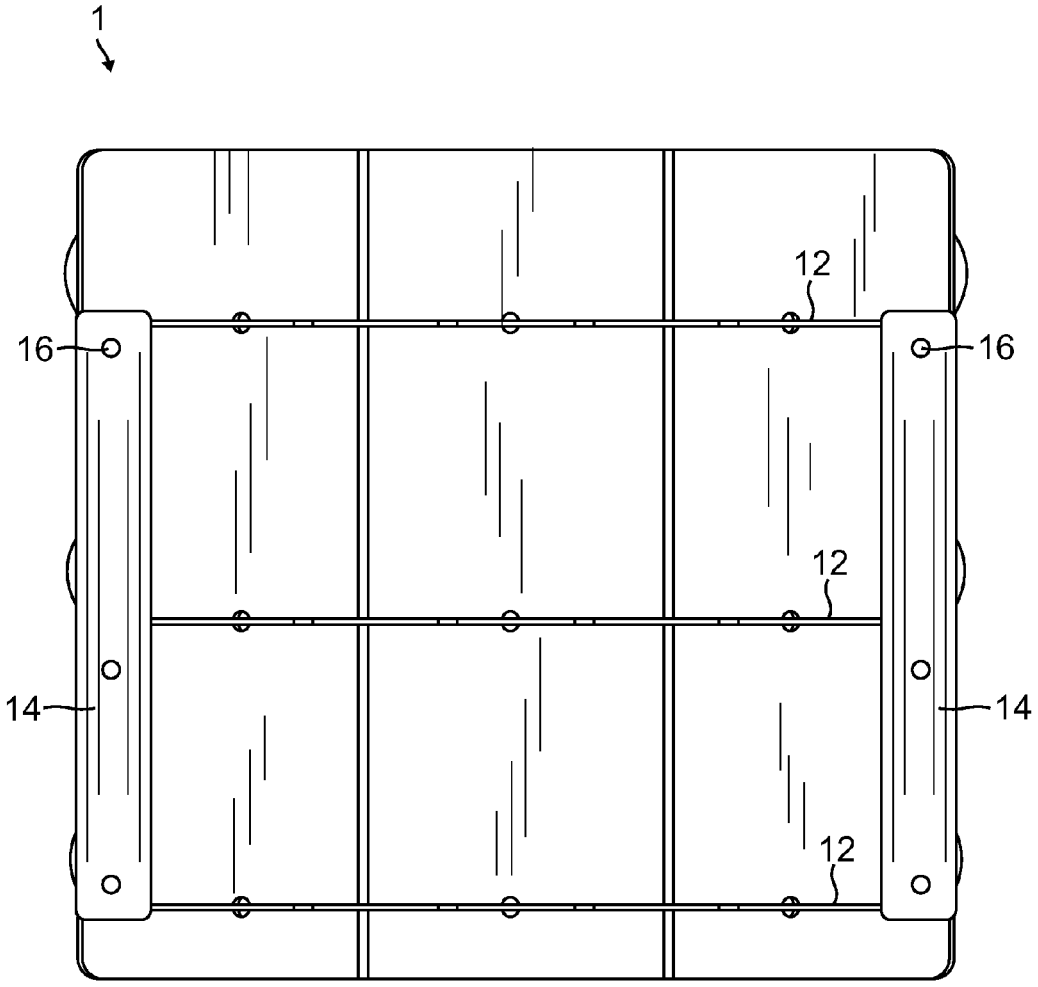
Figure 7:
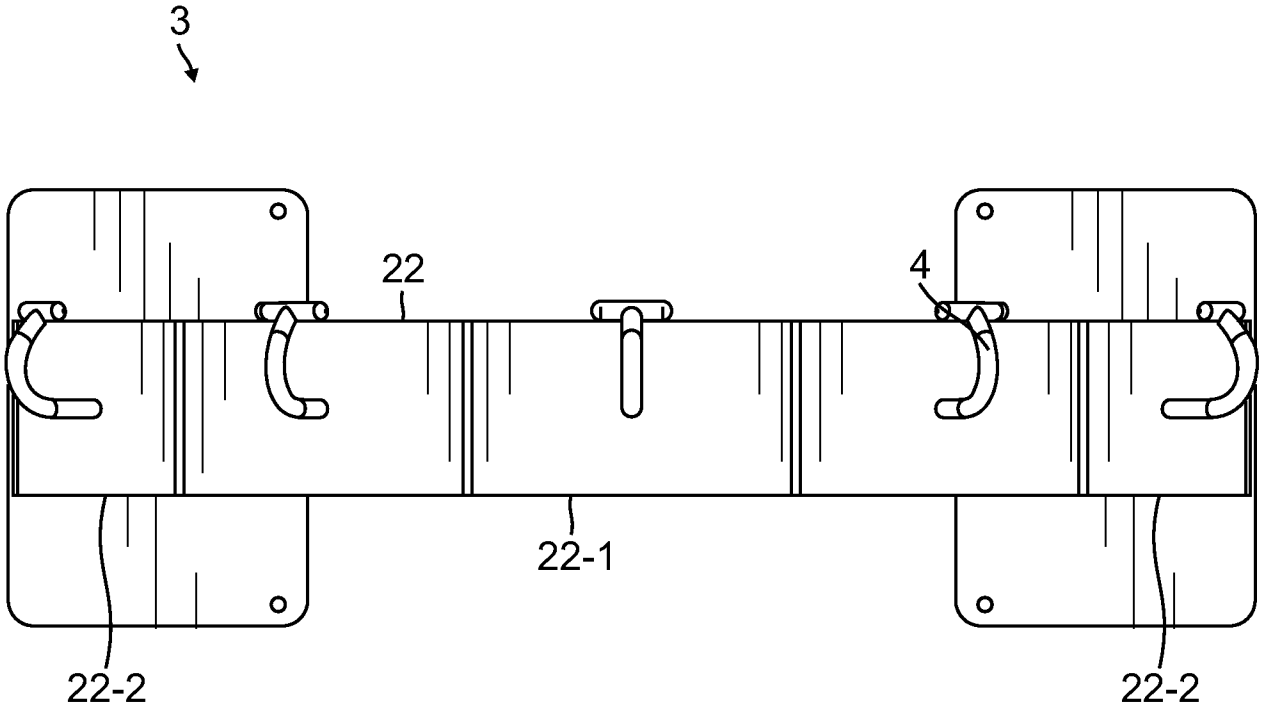
FIGS. 7-10 are front, side, top and back views of an upper unit of the multi-station resistance band exercise station of FIGS. 1 and 2.
Figure 8:
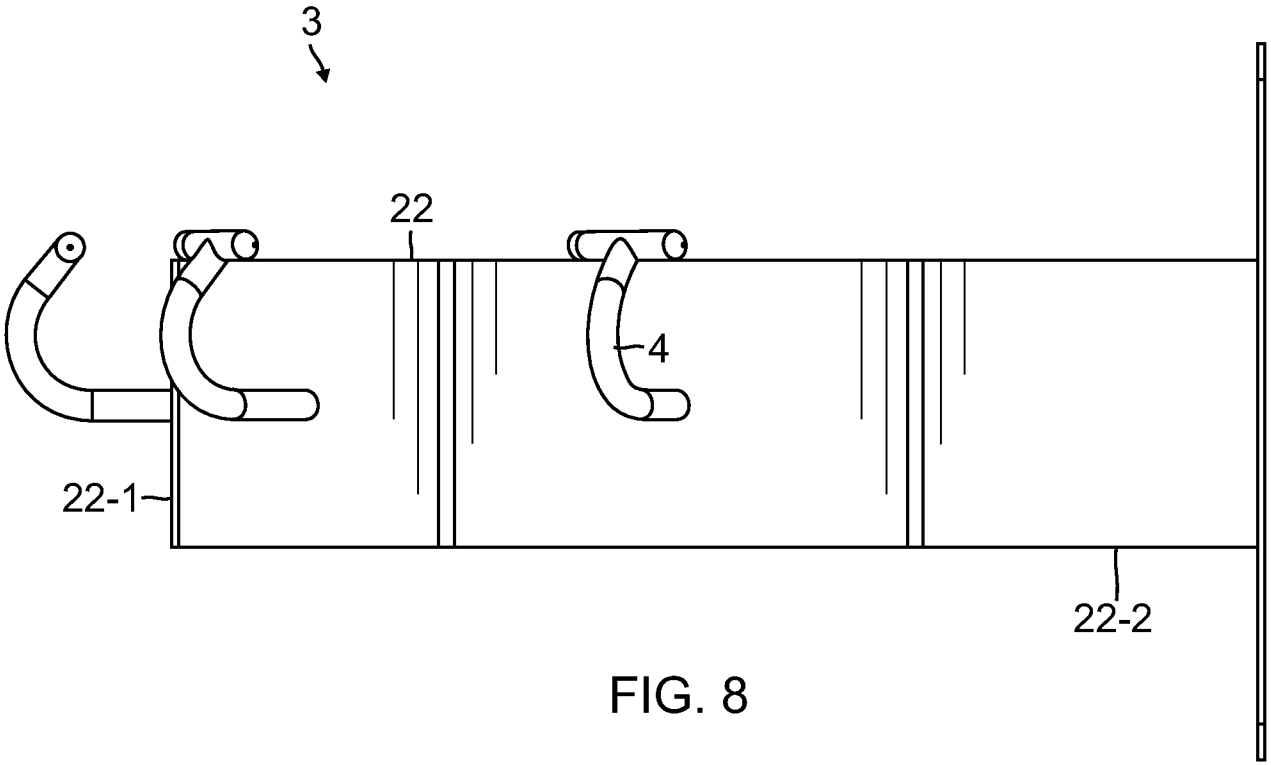

As shown in FIGS. 5 and 6, on the backside of the lower unit 1 are gussets 12 and wall mounting plates 14, which are preferably made of steel. The gussets 12 shown here has a plate shape and is disposed substantially horizontally and perpendicular to the mounting surface 5, providing load dispersion and the structural support for the mounting (preferably by welding) of the safety hooks 2. In this embodiment, there is one gusset 12 for each horizontal row of hooks 2; for a total of three gussets. The mounting plates 14 are located on each side of the unit 1 and are attached (preferably by welding) to the gussets 12 and mounting surface 5. Each wall mounting plate 14 has three mounting holes 16 coinciding with three mounting holes 17 on each of the side panel 5-1 (see FIG. 3). The lower unit 1 may be mounted to the wall studs via six wood screws, three on each side of the unit, using the holes on the wall mounting plates 14.

In this embodiment, the two side panels 5-1 are angled approximately 130 degrees with respect to the front panel 5-2 creating three independent exercise areas, one directly in front of the unit and one on each side of the unit.

FIGS. 7-10 further illustrate the upper unit 3 in the first embodiment shown in FIGS. 1-2 (the multi-station embodiment). In this embodiment, the upper unit 3 has a seven-sided horizontally shaped hook mounting surface 22 measuring, preferably, approximately 28.0 inches wide and 4.0 inches tall (see FIG. 7). Designed in the shape of an arc (see FIG. 9), the upper unit 3 extends, preferably, approximately 18 inches from the wall to the to the forward edge of the hook mounted on the center panel 22-1 of the mounting surface 22 (i.e., the hook furthest from the wall); and, preferably, approximately 15.0 inches from the wall to the forward edge of the mounting surface 22 (see FIG. 8). Two of the seven sides 22-2, i.e., the sides closest to the wall on each side of the unit 3, are about 4.77 inches long and are designed to add wall clearance. These two side panels 22-2 are void of hooks. The other five sides of the mounting surface 22 each measure approximately 7.5 inches long with a safety hook 4 mounted directly in the center of each panel for a total of five safety hooks.

The upper unit 3 is designed, preferably, to be mounted on the wall with the safety hooks 4 approximately 7.0 feet to 7.5 feet above the floor. With safety hooks 4 mounted on five of the seven sides of the mounting surface 22, users have five anchoring points from which to choose. The 18 inches of clearance, from the wall to the center or middle hook (see FIG. 8), is designed to enable users to perform exercises originating from above the head without interference from the wall.

Figure 9:
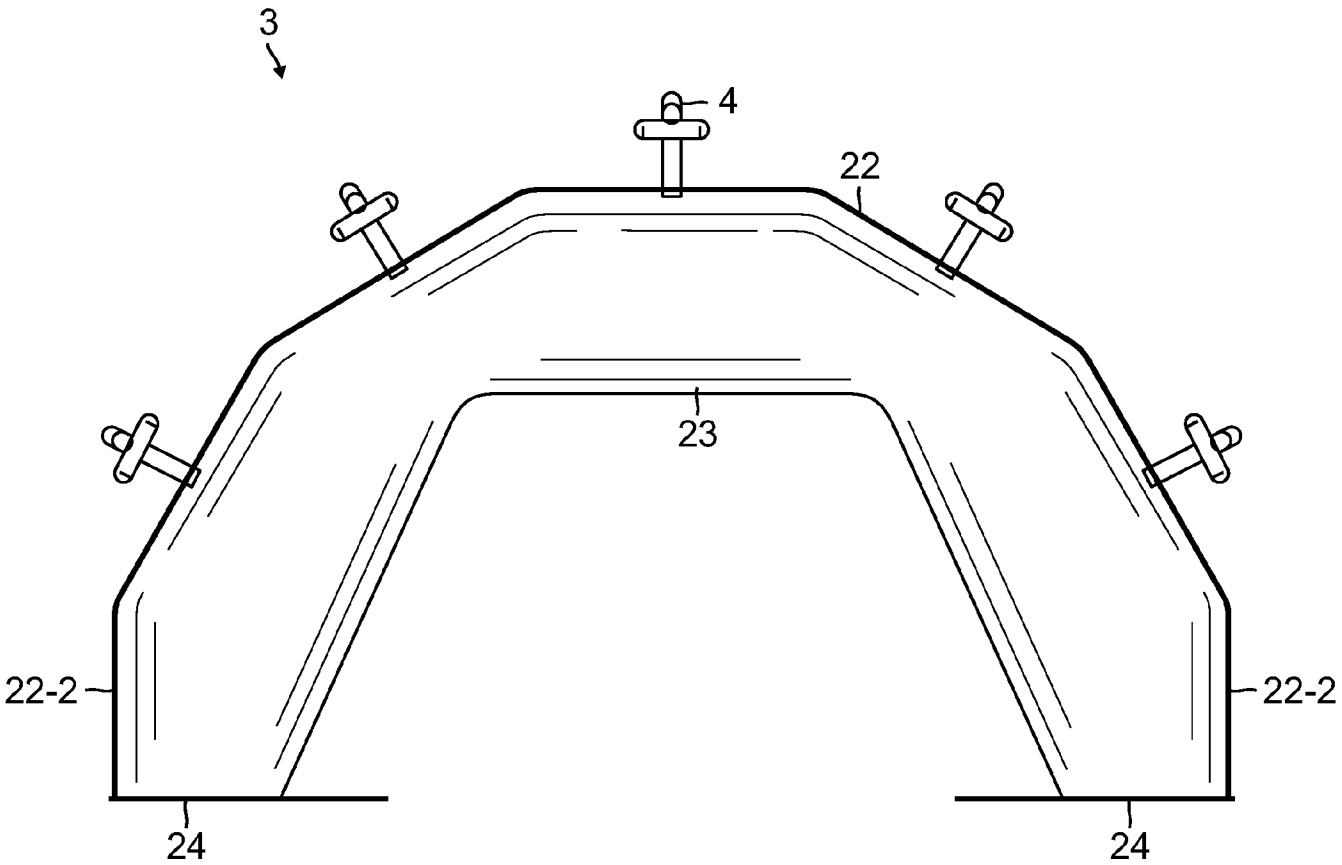
Figure 10:
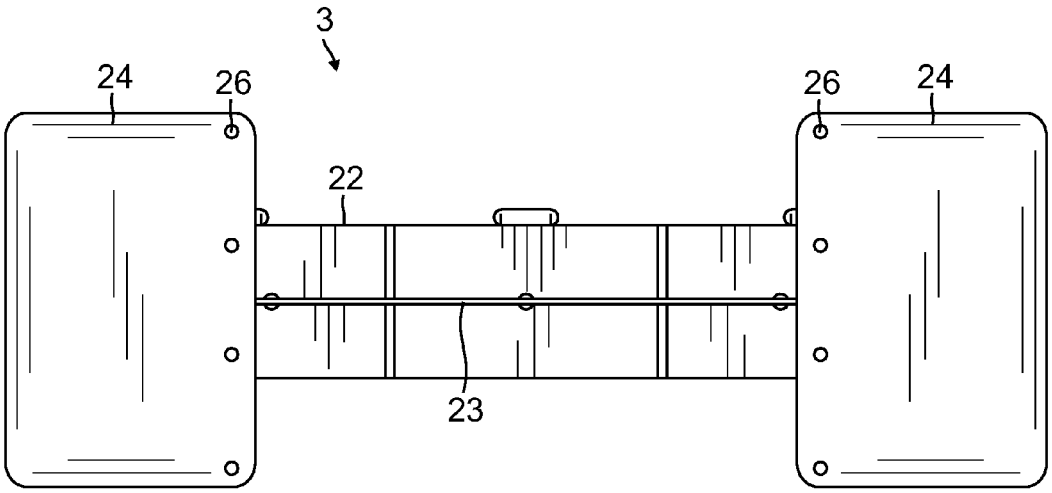

As shown in FIGS. 9 and 10, on the backside of the upper unit 3 is one gusset 23 and two wall mounting plates 24, which are preferably made of steel. The gusset 23 shown here has a plate shape and is disposed substantially horizontally and perpendicular to the mounting surface 22, providing structural support for the mounting (preferably by welding) of the safety hooks 4. In this embodiment, there is one gusset 23 for the upper unit 3. The mounting plates 24 are located on each side of the unit 3 and are attached (preferably by welding) to the gusset 23 and mounting surface 22. Each wall mounting plate 24 includes four mounting holes 26. The upper unit 3 may be mounted to the wall studs via eight wood screws, four on each side of the unit, using the holes on the wall mounting plates 24.

Figure 11:
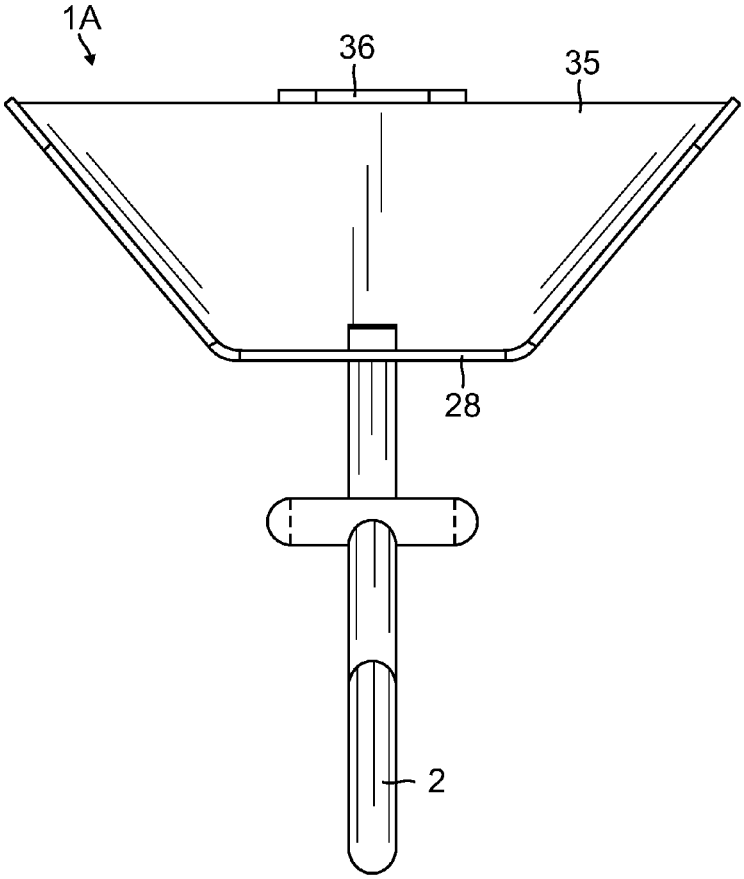
FIGS. 11-12 are top views of a lower unit and an upper unit of the single-station resistance band exercise station according to a second embodiment of the present invention.
Figure 12:
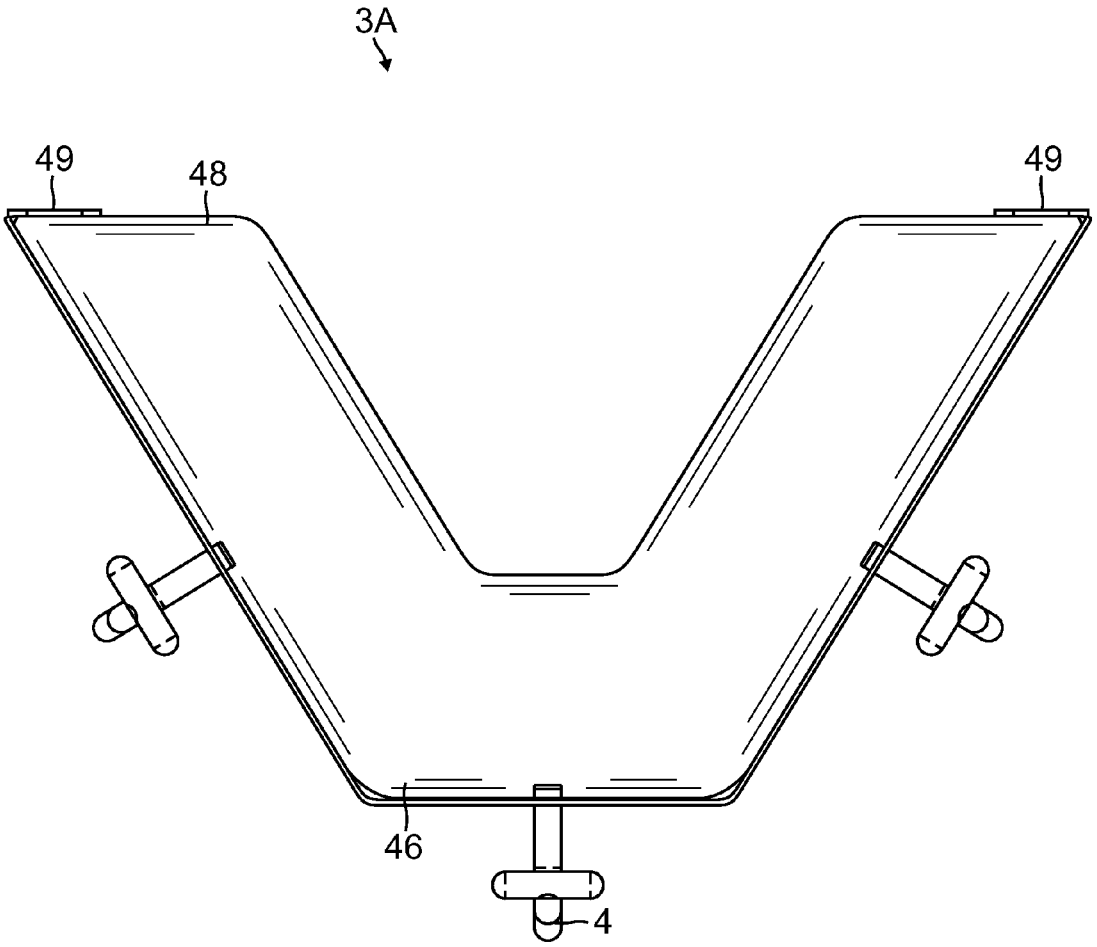

In a second embodiment, a resistance band exercise station (also referred to as the single-station embodiment) has one upper unit and three lower units. Each lower unit is similar to the lower unit 1 of the first embodiment but has only one vertical column of hooks in the center. The upper unit is similar to the upper unit 3 of the first embodiment but has a horizontal row of only three hooks. FIG. 11 illustrates the top views of the lower unit 1A of the second embodiment, showing hook 2, hook mounting surface 28, gusset 35 and wall mounting plate 36. FIG. 12 illustrates the top views of the upper unit 3A of the second embodiment, showing hooks 4, hook mounting surface 46, gusset 48 and wall mounting plates 49. Other views of the second embodiment are now shown, and one skilled in the art can readily understand the structure of the second embodiment from these top views. A detailed description of the second embodiment is omitted here.

While the gussets 12/23/35/48 shown in FIGS. 5, 6, 9, 10, 11 and 12 are flat gussets, other shapes may be used. For example, in an alternative embodiment (not shown), each gusset is made of rectangular tubes (e.g. one inch square steel tubes). The tubes are oriented parallel to the floor; a first tube extends along the inside of the entire mounting surface and is connected to it (e.g. by welding); a second tube extends across the space between the two ends of the first tube and is connected to the first tube, so that the two tubes form a trapezoidal shape. This alternative shape may be preferred due to its superior strength. Other shapes and constructions may also be used for the gussets.

In the first and second embodiments described above, the hook mounting surfaces 5, 22, 28 and 46 are preferably made of steel. However, any number of materials of sufficient strength could be used as a mounting surface for the safety hooks. Further, the mounting surfaces 5, 22, 28 and 46 are a plate. However, any number of mounting surfaces (e.g., wire frame, carbon fiber) may suffice and provide the necessary stability and load dispersion for exercises performed with resistance bands from one or more safety hooks.

In the first embodiment, three columns of three, equally vertically spaced hooks 2 are preferred on the lower units 1, and one row of five, equally horizontally spaced safety hooks 4 are preferred on the upper unit 3. In the second embodiment, one column of three vertical hooks is preferred on the lower units, and one row of three, horizontally spaced safety hooks are preferred on the upper unit. However, any number of safety hooks can be used in any number of configurations for the upper and lower units of the first and second embodiments.

In the first and second embodiments, the hook mounting surfaces 5 (of the lower unit 1), 22 (of the upper unit 3), and 46 (of the upper unit 3A) have multiple flat panels disposed at different angles so that hooks mounted on the multiple panels point at different directions. This feature is desirable as it creates multiple exercise areas that may be simultaneously used by different users for exercising. In alternative designs, each hook mounting surface 5, 22 or 46 may be a curved surface (rather than multiple plat panels), which can achieve the same function of allowing multiple mounted hooks to point at different directions. For convenience, in this disclosure and the appended claims, both the multiple-panel shape and the curved shape are generally referred to as an "arc shape".

Further, although the hook mounting surfaces 5, 22, 28 and 46 in the first and second embodiments have a continuous surface for mounting hooks, alternative mounting structure designs are possible for mounting the hooks, as long as they achieve the function stated above, i.e., to allow hooks mounted thereon to point at different directions. For example, each vertical column of hooks on the lower unit 1 shown in FIGS. 3-6 may be mounted on a separate frame structure, and the multiple frame structures are attached to each other to form a unit. More generally, any suitable hook mounting structure may be used for mounting the hooks.

The hooks 2 and 4 used in the first and second embodiments of the present invention are open-loop hooks without a closure member that closes the gate of the hook. In addition, they are preferably safety hooks, which are shaped to have a safety barrier fixedly disposed at the end or tip of the hooks. The safety barrier generally serves the function of preventing the band or strap that is looped through the hook from slipping off, or at least significantly reducing the chances of the band slipping off.

Figure 13:
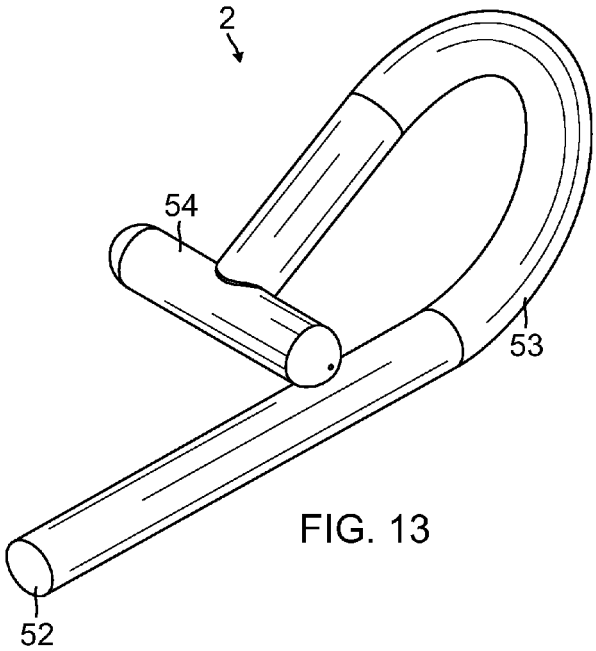
FIGS. 13-14 are perspective and side views of a safety hook useful in the resistance band exercise stations of various embodiments of the present invention.
Figure 14:
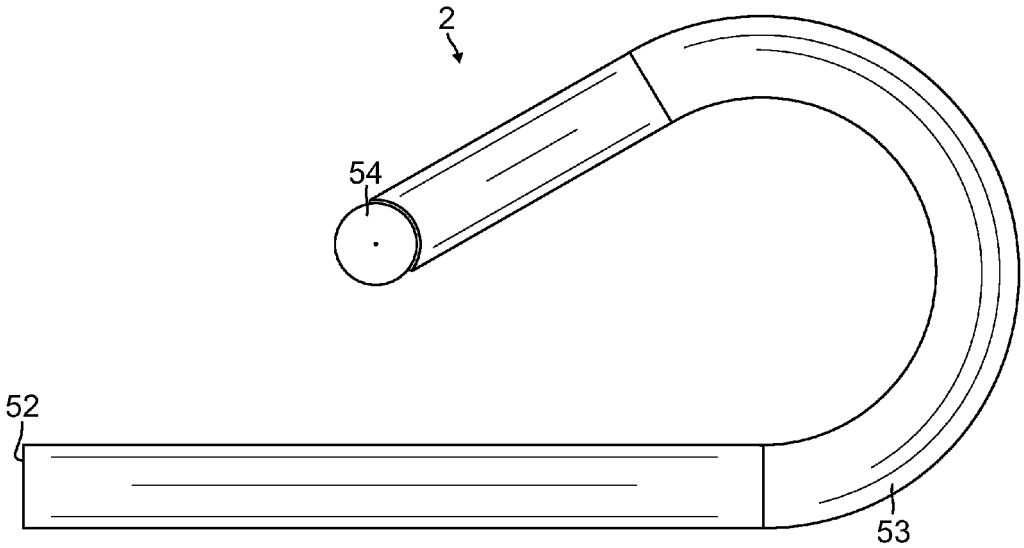
Figure 15:
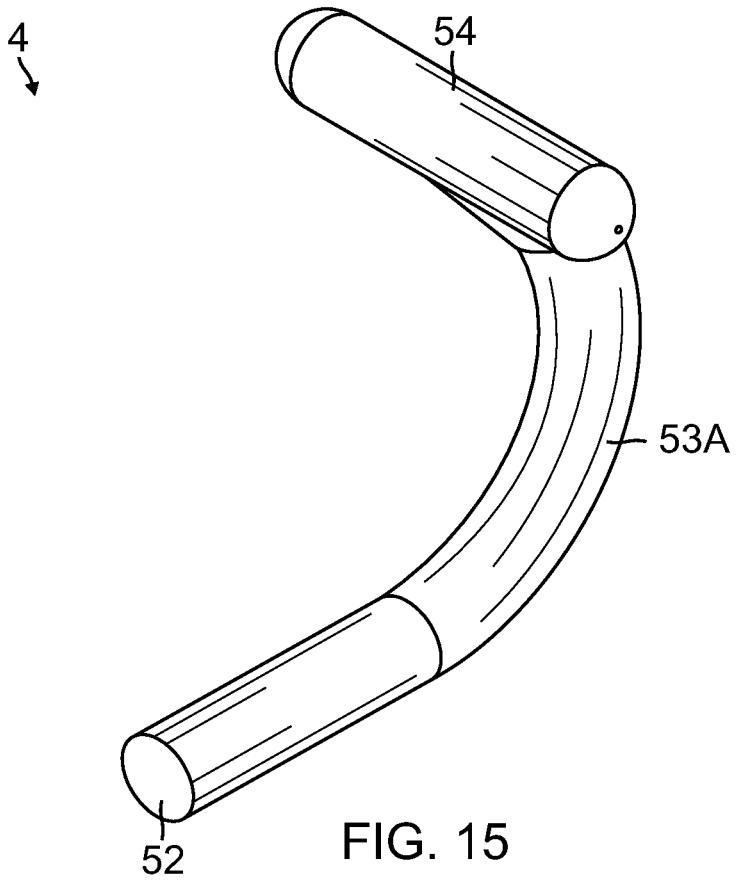
FIGS. 15-16 are perspective and side views of another safety hook useful in the resistance band exercise stations of various embodiments of the present invention.
Figure 16:
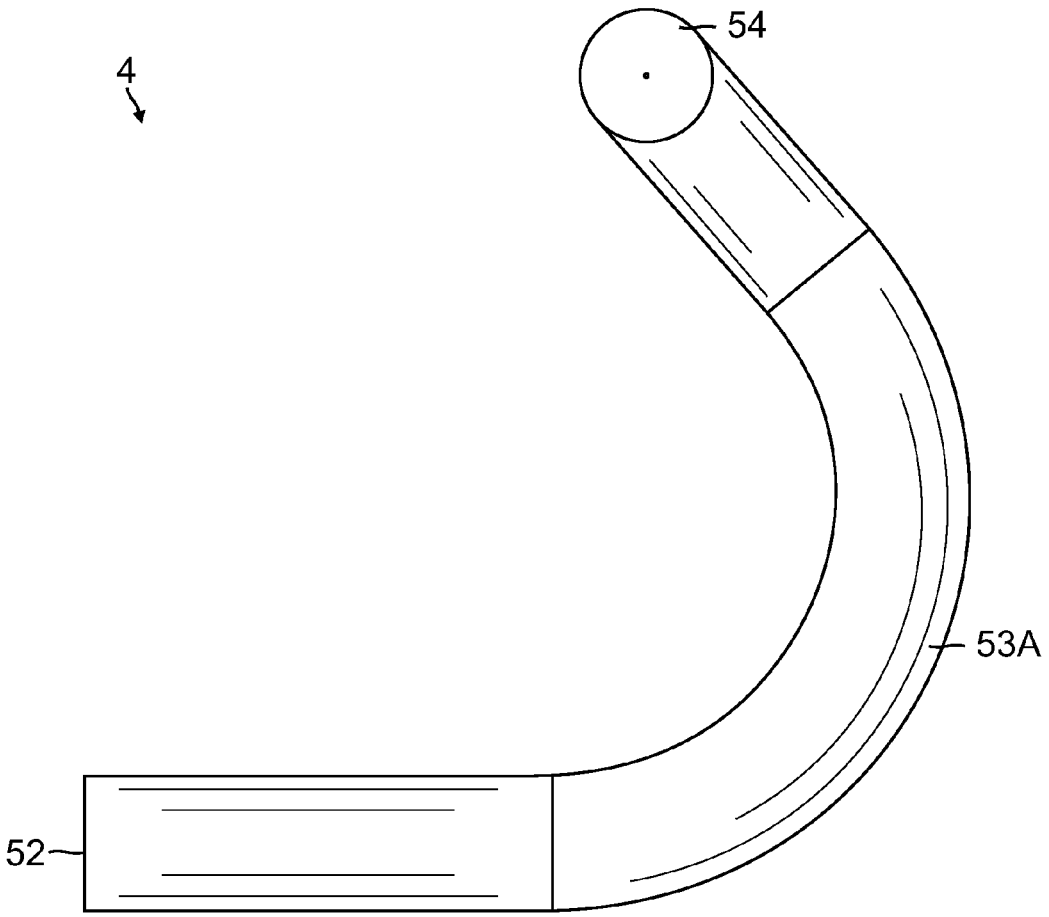

FIGS. 13 and 14 illustrate the structure of a safety hook 2 useful for the lower units 1 of the resistance band exercise station shown in FIGS. 1 and 2; FIGS. 15 and 16 illustrate the structure of a safety hook 4 useful for the upper units 3 of the resistance band exercise station shown in FIGS. 1 and 2. In both safety hooks 2 and 4, the hook has an elongated and curved body 53 or 53A, with a proximate end 52 for connecting to a support or mounting member, and a distal end that has a safety barrier member 54 connected thereto. In the illustrated embodiments, the barrier member 54 is a bar affixed (preferably by welding) to the distal end of the hook 2. The elongated body 53/53A generally lies in a plane, and the barrier bar 54 is disposed perpendicular to that plane. This configuration may be referred to as a T-bar configuration. The barrier member 54 may have other shapes, such as two bars in an X shape, a disk, a ball or ellipsoid, etc. Preferably, the barrier member 54 extends in both directions out of the plane formed by the hook body 53, thereby providing the function of preventing the resistance band or strap from slipping out of the hook or reducing the chances of such events. Generally, any suitable shape may be used as the barrier member 54 as long as it serves the above function. Further, the barrier member does not have to be located at the distal end of the hook body; it may be located along the hook body at a distance from the distal end.

The main difference between the hooks 2 and 4 shown in FIGS. 13-14 and 15-16 is the shape of the bodies 54 and 54A. The body 54 for the hooks 2 used in the lower unit 1 has a deeper bend and smaller opening than the hooks 4 used in the upper unit. This is because for the hooks 4 of the upper unit 3, the resistance bands normally only pull in a generally downward direction during exercise, while for the hooks 2 of the lower unit 1, the resistance bands can pull in a generally upward direction during exercise. In alternative embodiments, the same hooks (such as hooks 2 shown in FIGS. 13-14) are used in both the upper unit and the lower units of the resistance band exercise stations.

As shown in FIGS. 13-14, the hook 2 for the lower unit 1 extends outwardly, preferably, about 3 inches from the mounting surface with a backward curve in the hook body 53 resulting in a 0.82 inch opening from the tip of the hook (the barrier member 54) to the neck of the hook (i.e. the straight portion near the proximate end 52). The tip (the barrier member 54) is approximately 1.25 inches from the mounting surface. The barrier bar 54 measures approximately 1.75 inches across. These preferred measurements facilitate ease of use, i.e., user simply loops a band over the hook.

As shown in FIGS. 15-16, the hooks 4 for the upper unit 3 extends outwardly, preferably, approximately 2.54 inches from the mounting surface with a backward curve in the hook body 53A resulting in a 1.88 inch opening form the tip of the hook to the neck of the hook. The tip (the barrier member 54) of the hook is 1.75 inches from the mounting surface. The barrier member 54 measures approximately 1.75 inches across. The design of the hook 4 for the upper unit 3 is open (i.e., 1.88 inch opening) to allow users to easily loop bands around the hook from below.

Figure 17:
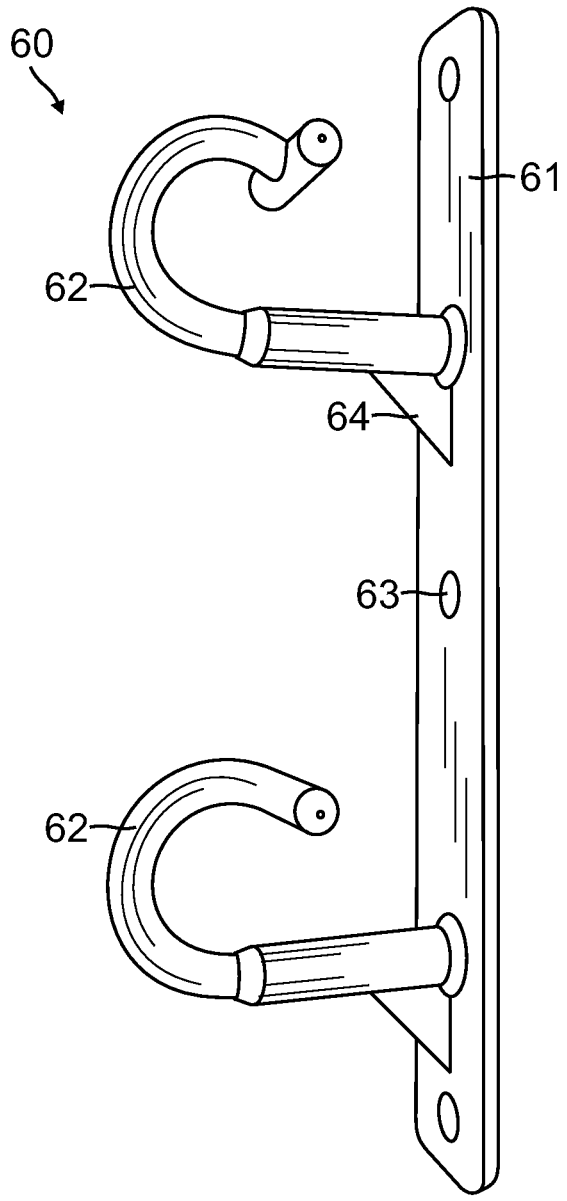
FIG. 17 illustrates a hook plate useful in forming a simplified resistance band exercise station according to a third embodiment of the present invention.
Figure 18:
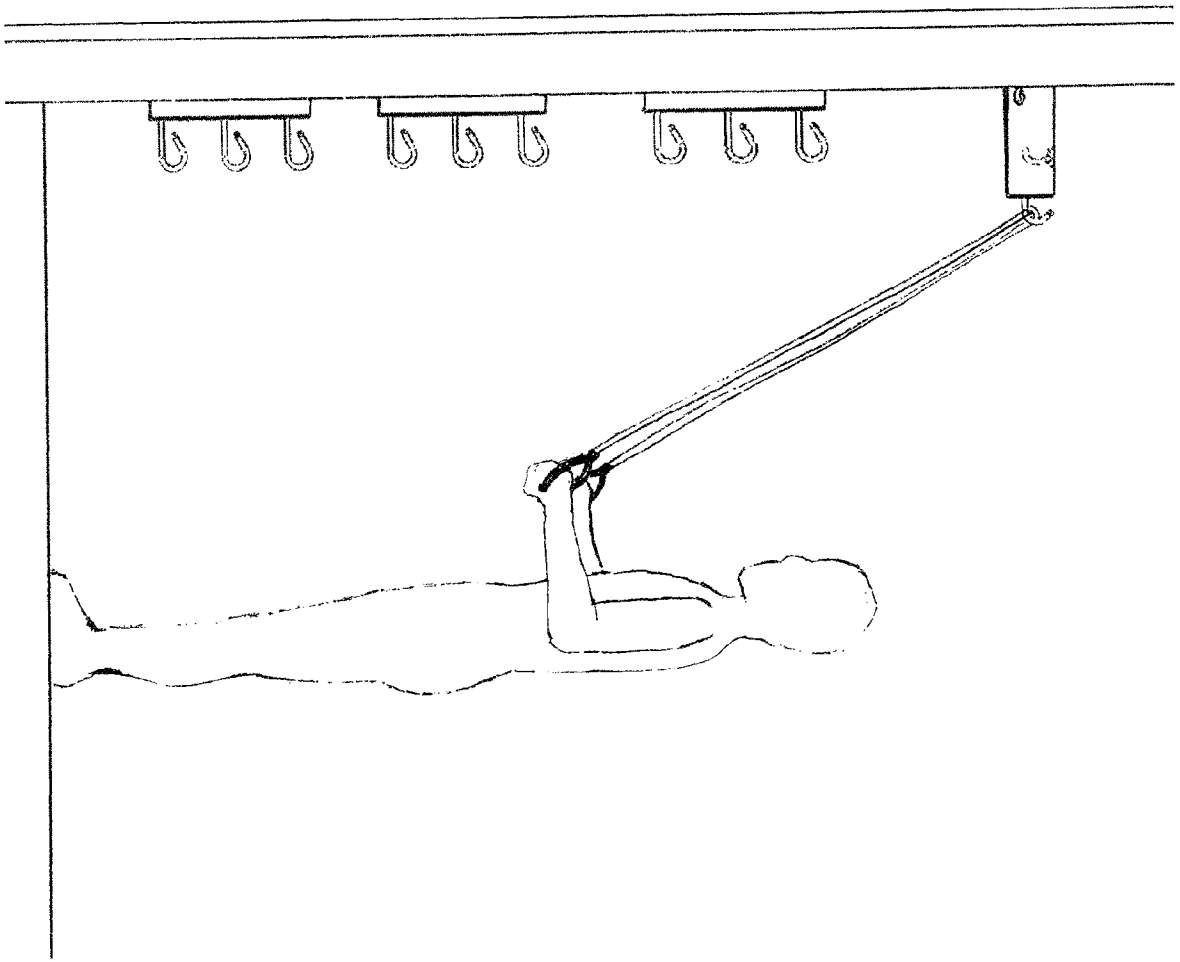
FIGS. 18-21 illustrate a person performing various exercises on a resistance band exercise station according to various embodiments of the present invention.
Figure 19:
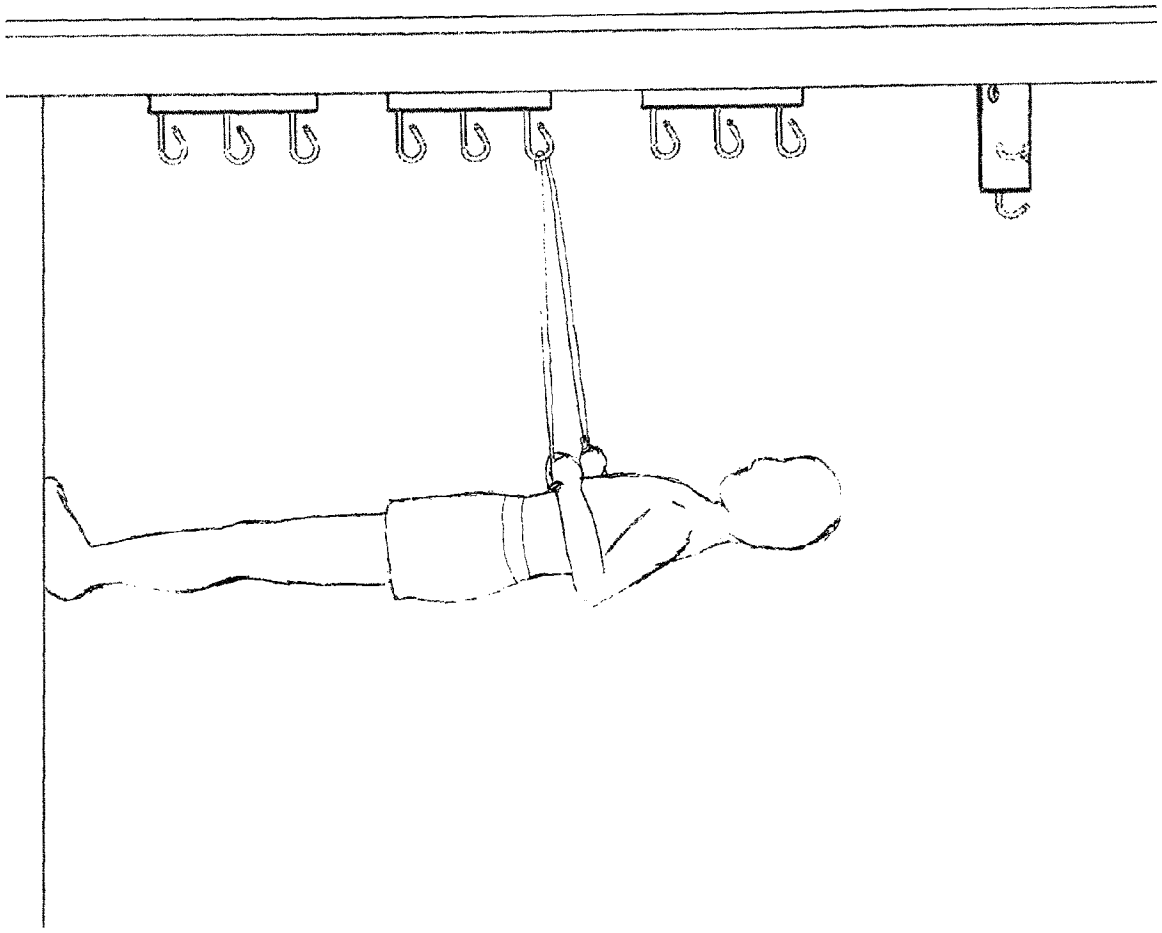
Figure 20:
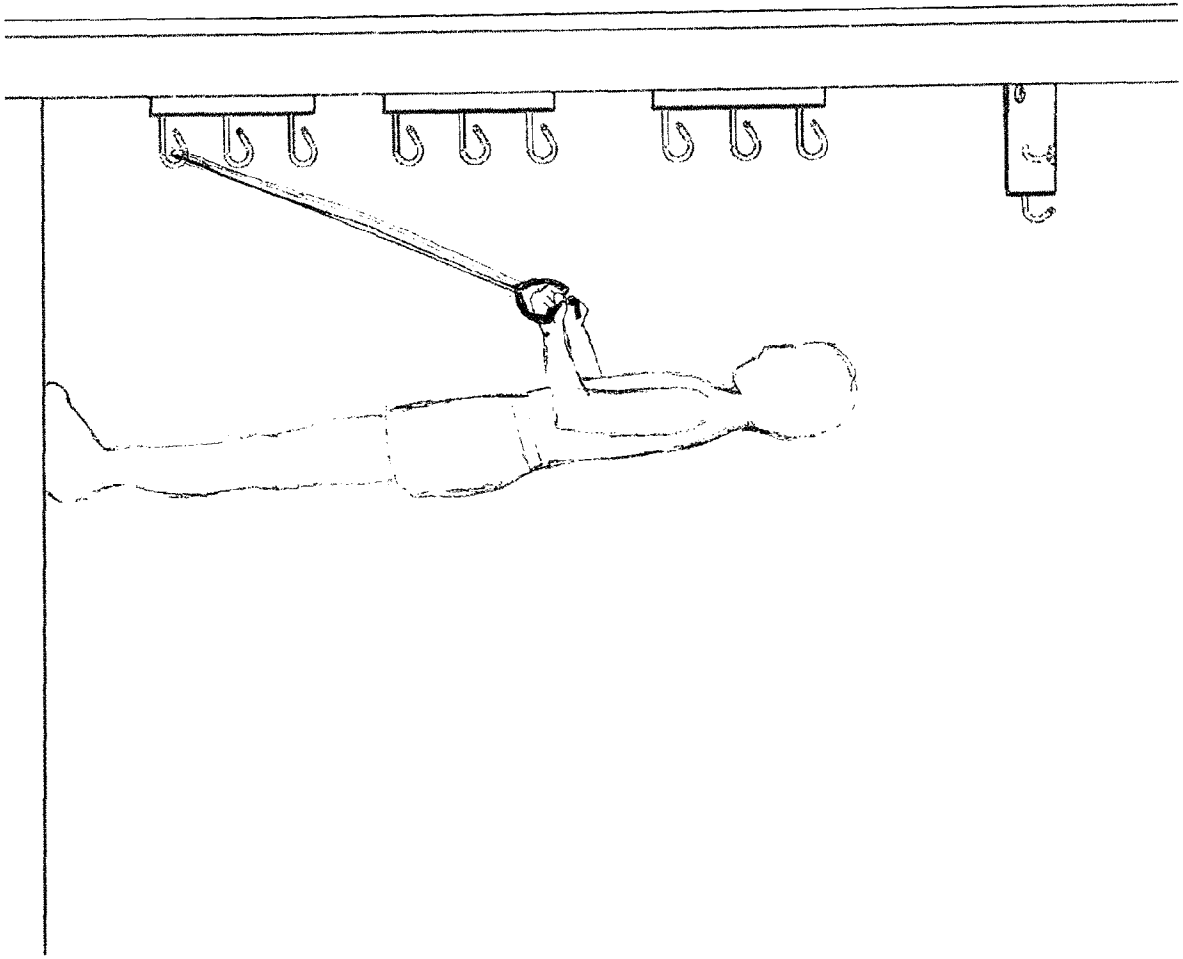

For strength, the preferred material for the hooks 2 and 4 is steel rod. However, any number of materials may be used as long as they provide sufficient strength. For added strength, the neck portions are preferably reinforced with a steel (or other material) tube over the steel rod. This tube helps to provide the necessary strength to withstand the stress of resistance band exercises, suspension exercises and stretching on a constant basis. This greatly reduces the potential for failure when pulled from a wide range of angles with significant resistance. The tube is not shown in FIGS. 13-16, but is seen in FIG. 17 which will be described in more detail later. It is noted that this design only strengthens the neck at the stress point (where the hook is mounted to the mounting structure). If the thickness of the rest of the hook is also increased, the interior of the curved portion of the hook would lose its anchoring capability and the size of the entire hook would have to be increased.

In contrast to conventional closed loop systems such as a d-ring, the safety hook according to embodiments of the present invention is a versatile open-faced anchoring device that eliminates the limitations associated with closed-looped systems. For example, when using a resistance band in a closed loop system, the user must either thread the band through the loop (if it is large enough) or use a clip hook or carabineer type device to secure the bands to the loop. In an open-loop system as in embodiments of the present invention, the user simply loops the band over the hook and begins to exercise.

Figure 21:
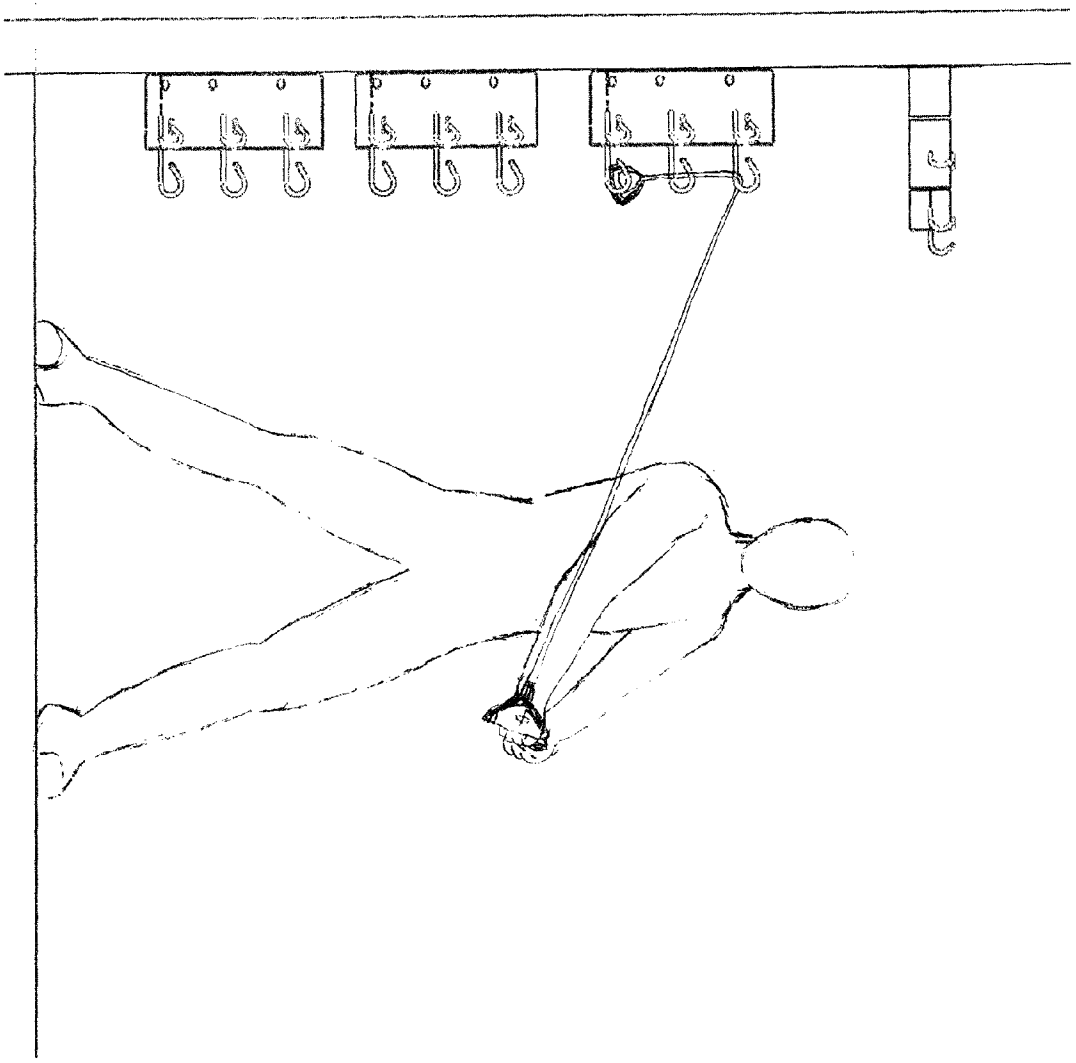

The open-loop safety hook also provides the platform for users to adjust the length and tension of a band or strap by anchoring a band or strap to one hook and threading it through a second hook (this exemplary use is schematically illustrated in FIG. 21). Threading is made possible by the barrier member (e.g. the T-bar) on the distal end of the hook. This allows bands or straps to be anchored to the safety hook in a number of different angles within an open-loop system. For example, to increase the tension of a resistance band, a user may anchor a band on a lower safety hook (e.g. one of the hooks 2 in FIGS. 1-2) and thread it through an upper safety hook (e.g. one of the hooks 4 in FIGS. 1-2). The band on the lower safety hook is anchored securely against the barrier member. The band continues up and is threaded through the neck and rounded portion of the upper safety hook.

To adjust the length of straps, most of the commercially available straps use adjustment buckles and strap extenders. The buckles operate like a common luggage strap buckle that increases or decrease the length of the strap. Strap extenders are straps of varying lengths that increase the length of the anchoring portion of the strap. These straps are attached together using carabineers or clip hooks. The safety hook according to embodiments of the present invention provides a much simpler solution. The user simply anchors the end of the strap on one safety hook of the resistance band exercise station and threads it through a second safety hook of the resistance band exercise station to get the desired length of strap. Because the resistance band exercise station (either the multi-station embodiment of FIGS. 1-2 or the single-station embodiment) has multiple safety hooks, the user can easily choose two hooks to construct a suitable length adjustment.

In summary, the safety hooks are designed to (a) allow users to use the most commonly used forms of resistance bands, i.e., standard resistance bands, JC Bands and flat bands; (b) stop bands and straps from slipping off the hook; (c) facilitate transitions between exercises; (d) allow users to safely use bands or straps in exercises that require pulling from a side angle to the hook; and (e) enable users to shorten the length of a band or strap by threading the band through multiple hooks, i.e., hooking the band on one hook and threading it through a second or third hook to shorten its length and thereby increase its resistive properties.

While specific values of dimensions, angles and other parameters are given in the above descriptions, the invention is not limited to these specific values. For example, each individual component of the invention may be any size as long as it meets the strength requirements necessary to meet its functional purpose.

In use, when mounting the resistance band exercise station (either the first or second embodiment) in a fitness or rehabilitative environment, three lower units 1 are preferably mounted at approximately ankle height or six inches from the floor, waist height or about 36 inches from the floor and chest height or about 48 inches from the floor (measured from the center of each unit). One upper unit 3 is preferably mounted above the head or about seven feet from the floor. Other heights are also possible depending on need.

The exercise values of the resistance band exercise station of the embodiments shown and described above can also be accomplished by a simplified system. In a third embodiment shown in FIG. 17, a number of safety hooks 62 (two are shown here) are mounted directly to a flat mounting plate 61 to form a hoot plate 60. The safety hooks 62 may have the same or similar structures as the hooks 2 or 4 shown in FIGS. 13-16. The hook plate 60 can be directly mounted to the wall via a plurality of holes 63, and can be used even in homes. The mounting plate 61 can be a vertically oriented rectangular shaped plate or can be of another shape that provides sufficient structural support for the safety hooks. While the hooks 62, in the embodiment shown in FIG. 17, are arranged in a vertical column, they can also be configured in a horizontal row of hooks mounted to a horizontally oriented rectangular shaped mounting plate. In the embodiment shown in FIG. 17, two safety hooks 62 are mounted to the mounting plate 61. However, any number of safety hooks can be mounted to a mounting plate, e.g., one safety hook or three safety hooks.

A small triangular gusset 64 jointed to the safety hook 62 (below the neck) and the mounting plate 61 provides additional support to the safety hook. While the gusset 64 in this embodiment is in the shape of a triangle, any number of gussets structures may be used to accomplish the objective of providing structural support to the safety hooks. Although not shown in FIGS. 1-12, in the first and second embodiments, a gusset similar to gusset 64 may be provided for each of hooks 2 and 4.

The hook plate 60 according to the third embodiment may be used to form a modular system with mounting flexibility. In use, three to four individual pieces of hook plate 60 (each having a suitable number of hooks) are mounted at various heights to form a complete system. The modular nature of the system allows users important flexibility in mounting the hook plates 60 to a wall. While the preferred configuration is that of a vertical stack of hook plates, the user has the option of mounting each individual component in separate locations to create separate exercise stations. For example, one hook plate can be mounted on one wall at ankle height—six inches from the floor, a second hook plate can be mounted on a second wall at waist height—approximately 34-inches from the floor, a third component can be mounted on yet a third wall at chest height—approximately 60 inches, and a the fourth component can be mounted to a fourth wall above the head at seven feet. This provides the user significant flexibility in creating an effective and efficient exercise space. The exercises shown in FIGS. 18-21 can be performed on a system formed of hook plates 60.

More generally, in the first, second and third embodiments, each of lower unit 1, upper unit 3, or hook plate 60 may be referred to as a hook unit. Each hook unit has a hook mounting structure and one or more safety hooks attached to the hook mounting structure. One or more hook units (preferably four units), mounted at suitable heights, collectively form a resistance band exercise station.

It will be apparent to those skilled in the art that various modification and variations can be made in the resistance band exercise station of the present invention without departing from the spirit or scope of the invention. Thus, it is intended that the present invention cover modifications and variations that come within the scope of the appended claims and their equivalents.

What is claimed is:

1. An exercise unit for an exercise station consisting essentially of:

a mounting panel defining a mounting plane; and a plurality of hook structures connected to the mounting panel wherein at least one of the plurality of hook structures is connected to the mounting panel below at least one other hook structure of the plurality of hook structures, and wherein each of the plurality of hook structures consists essentially of a horizontal neck portion extending perpendicular from the mounting plane to a distal end of the horizontal neck portion, an arc shaped hook body having a proximal end, extending from the distal end of the horizontal neck portion and curving through an arc initially upward, then back toward the mounting panel and downward to a distal end of the arc shaped hook body, and a barrier member connected to the distal end of the arc shaped hook body and extending in a direction perpendicular to the horizontal neck and parallel to the mounting plane, wherein, for each hook structure, the arc shaped hook body resides in a hook plane that is perpendicular to the mounting plane and the horizontal neck portion resides in the hook plane, wherein the upper hook structure and the lower hook structure are coplanar and reside in the hook plane.

2. The exercise unit of claim 1, wherein each hook structure has sufficient strength to support an adult human via one or more suspension straps.

3. The exercise unit of claim 1, wherein, for each hook structure, the distal end of the arc shaped hook body is connected to a midpoint of the barrier member.

4. The exercise unit of claim 3, wherein, for each hook structure, the barrier member comprises a linear bar disposed perpendicular to a hook plane formed by the hook body.

5. The exercise unit of claim 4, wherein, for each hook structure, the barrier member consists of the linear bar.

6. The exercise unit of claim 1, wherein, for each hook structure, the horizontal neck portion comprises:

a substantially cylindrical rod; and a substantially cylindrical reinforcing tube member connected to the rod and extending around the rod.

7. The exercise unit of claim 6, further comprising, for each hook structure, a reinforcing gusset connected to the reinforcing tube member and the first mounting panel below the reinforcing tube member.

8. The exercise unit of claim 1, further comprising, for each hook structure, a reinforcing gusset connected to the horizontal neck portion and the first mounting panel below the horizontal neck portion.

9. The exercise unit of claim 1, further comprising a plurality of mounting holes in the mounting panel for securing the first mounting panel to a structure.

10. The exercise unit of claim 1, further comprising a plurality of mounting holes in the first mounting panel for securing the first mounting panel to a structure, the plurality of mounting holes comprising an upper mounting hole above the upper hook structure, a lower mounting hole below the lower hook structure, and a middle mounting hole between the upper hook structure and the lower hook structure.

11. The exercise unit of claim 1, wherein the arc of each arc shaped hook body is a substantially circular arc that extends through substantially two hundred ten (210) degrees between the proximal end and the distal end of the arc shaped hook body.

12. The exercise unit of claim 1, wherein the mounting panel and the at least one hook structure are made of steel.

13. The exercise unit of claim 1, wherein:

each barrier member comprises a bar disposed perpendicular to the hook plane and the distal end of each arc shaped hook body is connected to a midpoint of the barrier member;

each horizontal neck portion comprises a substantially cylindrical rod and a substantially cylindrical reinforcing tube member connected to the rod and extending around the rod; and each hook structure further comprises a reinforcing gusset connected to the reinforcing tube member and the mounting panel below the reinforcing tube member, and a plurality of mounting holes in the mounting panel for securing the mounting panel to a structure comprising an upper mounting hole above the upper hook structure, a lower mounting hole below the lower hook structure, and a middle mounting hole between the upper hook structure and the lower hook structure.

14. The exercise unit of claim 1, wherein the mounting panel is the first mounting panel, further comprising a second mounting panel that is coupled to a first edge of the first mounting panel and defines a second mounting plane and a third mounting panel that is coupled to a second edge of the first mounting panel and defines a third mounting plane, such that the first mounting panel is positioned between the second mounting panel and the third mounting panel, and the three mounting planes are not parallel with one another, wherein the second mounting panel and the third mounting panel each comprise at least one additional hook structure, each additional hook structure consists essentially of:

a horizontal neck portion extending perpendicular from the mounting plane to a distal end of the horizontal neck portion;

an arc shaped hook body having a proximal end extending from the distal end of the horizontal neck portion and curving through an arc initially upward, then back toward the mounting panel and downward to a distal end of the arc shaped hook body; and a barrier member connected to the distal end of the arc shaped hook body and extending in a direction perpendicular to the horizontal neck and parallel to the mounting plane.

15. The exercise unit of claim 14, wherein each of the second and third mounting panels is connected to a respective first and second wall mounting plate wherein the first and second wall mounting plates are coplanar.

16. The exercise unit of claim 15, further comprising a plurality of mounting holes in each of the first and second wall mounting plates for securing the exercise unit to a structure.

17. The exercise unit of claim 16, wherein:

each arc shaped hook body resides in a hook plane that is perpendicular to the corresponding mounting plane, and the horizontal neck portion resides in the hook plane;

each barrier member comprises a linear bar disposed perpendicular to a hook plane formed by the hook body and the distal end of the arc shaped hook body is connected to a midpoint of the barrier member;

each horizontal neck portion comprises a substantially cylindrical rod and a substantially cylindrical reinforcing tube member connected to the rod and extending around the rod;

the second mounting panel is connected to the first mounting panel such that the first mounting plane intersects the second mounting plane at a one hundred thirty (130) degree angle;

the third mounting panel is connected to the first mounting panel such that the first mounting plane intersects the third mounting plane at a one hundred thirty (130) degree angle; and the exercise unit further comprises a reinforcing gusset connected to each reinforcing tube member and the corresponding mounting panel below the reinforcing tube member, and at least one horizontal gusset connected to and arranged perpendicular to the first, second and third mounting panels.

18. The exercise unit of claim 14, wherein the first mounting plane intersects the second mounting plane at a one hundred thirty (130) degree angle, and the first mounting plane intersects the third mounting plane at a one hundred thirty (130) degree angle.

19. The exercise unit of claim 15, wherein the exercise unit is configured to be secured to a vertical structure above a horizontal floor structure such that the first mounting plane is parallel to the vertical structure, and the first, second and third mounting planes are perpendicular to the horizontal floor surface.

20. The exercise unit of claim 14, further comprising at least one horizontal gusset connected to and arranged perpendicular to the first, second and third mounting panels.

* * * * *